US007278882B1

(12) United States Patent
Li

(10) Patent No.: US 7,278,882 B1
(45) Date of Patent: Oct. 9, 2007

(54) LEAKAGE PREVENTIVE CABLE CONNECTOR

(75) Inventor: Ching-Chieh Li, Taichung County (TW)

(73) Assignee: Cablesat International Co., Ltd., Taichung (TW)

( * ) Notice: Subject to any disclaimer, the term of this patent is extended or adjusted under 35 U.S.C. 154(b) by 0 days.

(21) Appl. No.: 11/647,385

(22) Filed: Dec. 29, 2006

(30) Foreign Application Priority Data

Oct. 16, 2006 (TW) ..... 95138126 A

(51) Int. Cl.
*H01R 9/05* (2006.01)

(52) U.S. Cl. ..... 439/578; 439/583; 439/584

(58) Field of Classification Search ..... 439/578, 439/583, 584

See application file for complete search history.

(56) References Cited

U.S. PATENT DOCUMENTS 5,997,350 A * 12/1999 Burris et al. ..... 439/585
7,125,283 B1 * 10/2006 Lin ..... 439/578
7,128,603 B2 * 10/2006 Burris et al. ..... 439/578
7,144,272 B1 * 12/2006 Burris et al. ..... 439/578
2004/0147164 A1 * 7/2004 Li ..... 439/578
2004/0219833 A1 * 11/2004 Burris et al. ..... 439/578

* cited by examiner

*Primary Examiner*—Tho D. Ta
(74) *Attorney, Agent, or Firm*—Browdy and Neimark, PLLC

(57) ABSTRACT

A cable connector includes a tubular casing, which has an axial through hole axially extending through two ends thereof and a neck axially forwardly extending from one end, a locknut, which has an inner thread for fastening to an external device and a coupling hole disposed at one end and coupled to the neck of the tubular casing and having an inner diameter smaller than the inner diameter of the locknut and approximately equal to the outer diameter of the neck, an inner tube, which has an axial through hole extending through two distal ends thereof, a stop flange extended around the periphery of one end thereof and stopped against the neck of the tubular casing, and a stretching portion formed on the periphery thereof adjacent to the stop flange and stopped against the inside wall of the neck of the tubular casing to force the neck into friction engagement with the inside wall of the locknut, and a collar, which is coupled to one end of the tubular casing and forcible onto the tubular casing toward the other end of the tubular casing by an external push force.

7 Claims, 3 Drawing Sheets

LEAKAGE PREVENTIVE CABLE CONNECTOR

BACKGROUND OF THE INVENTION

1. Field of the Invention

The present invention relates to cable connection devices and more particularly, to a cable connector that prevents leakage problems.

2. Description of the Related Art

FIG. 1 shows a conventional cable connector. According to this design, the cable connector is comprised of a hollow cylindrical casing 1, an inner tube 2, a locknut 3, and a sleeve 4. The casing 1 has a front neck 5, and an outside annular groove 6 extending around the periphery of the front neck 5. The locknut 3 is mounted on the front neck 5. Further, a rubber O-ring 7 is fastened to the outside annular groove 6 of the front neck 5 and stopped against the inside wall of the locknut 3 to seal the gap. The processing of the outside annular groove 6 on the front neck 5 of the casing 1 and use of the rubber O-ring 7 greatly increases the cost of the cable connector. Further, the rubber O-ring 7 will be aged after a certain period of use, hence loosing its sealing function.

SUMMARY OF THE INVENTION

The present invention has been accomplished under the circumstances in view. It is one object of the present invention to provide a cable connector, which saves much material cost and installation time, and effectively prevents leakage problems.

To achieve this and other objects of the present invention, the cable connector comprises a tubular casing, which has an axial through hole axially extending through first and second ends thereof and a neck axially forwardly extending from the first end, a locknut, which has an inner thread for fastening to an external device and a coupling hole disposed at one end and coupled to the neck of the tubular casing and having an inner diameter smaller than the inner diameter of the locknut and approximately equal to the outer diameter of the neck, an inner tube, which has an axial through hole extending through two distal ends thereof, a stop flange extended around the periphery of one end thereof and stopped against the neck of the tubular casing, and a stretching portion formed on the periphery thereof adjacent to the stop flange and stopped against the inside wall of the neck of the tubular casing to force the neck into friction engagement with the inside wall of the locknut, and a collar, which is coupled to the second end of the tubular casing and forcible onto the tubular casing toward the first end of the tubular casing by an external push force.

DETAILED DESCRIPTION OF THE INVENTION

Figure 1:
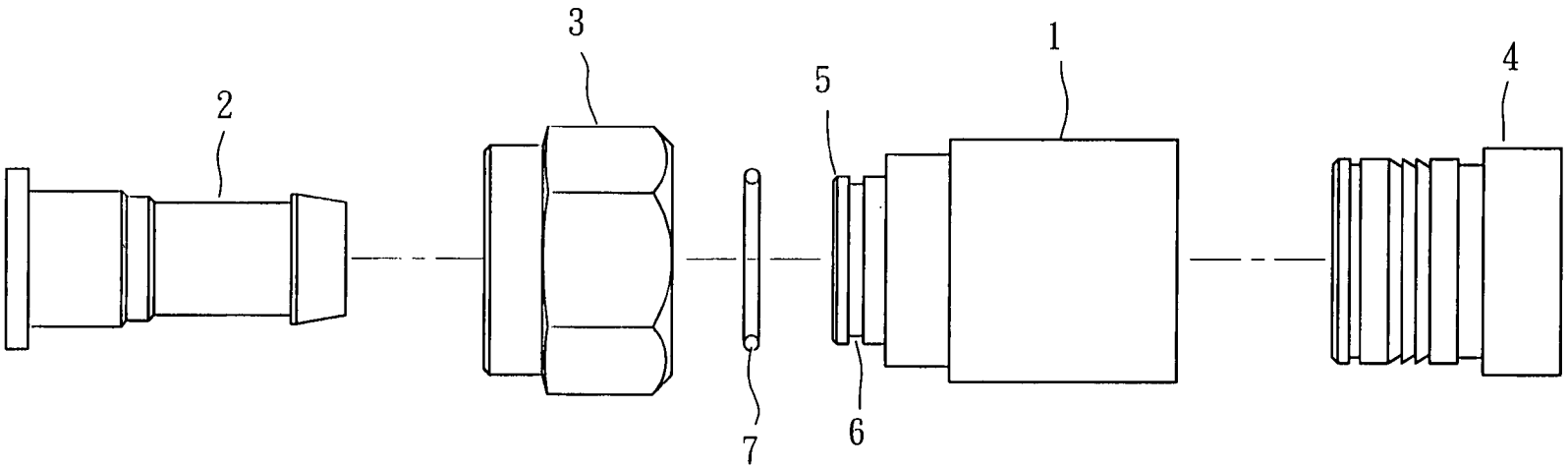
FIG. 1 PRIOR ART
FIG. 1 is an exploded view a cable connector according to the prior art.
Figure 2:
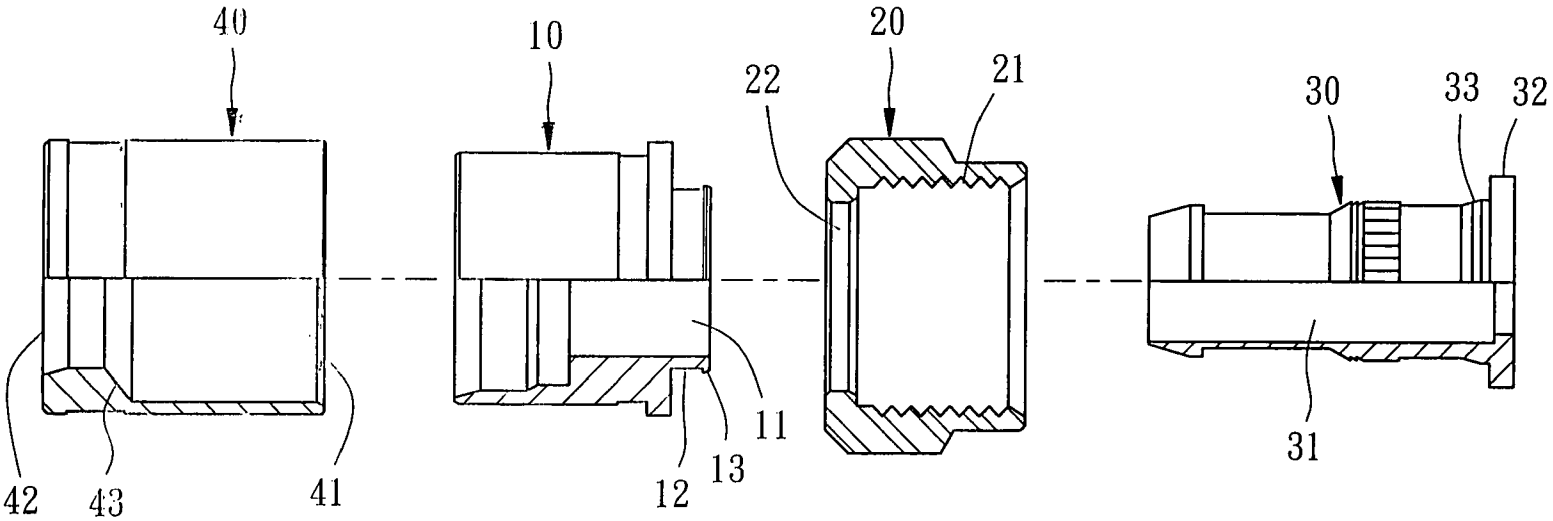
FIG. 2 is a sectional exploded view of a cable connector according to the present invention.
Figure 4:
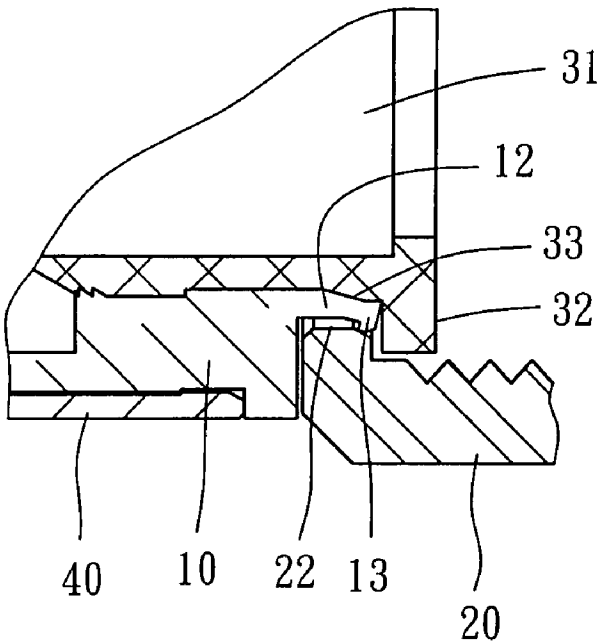
FIG. 4 is an enlarged view of a part of FIG. 3.
Figure 3:
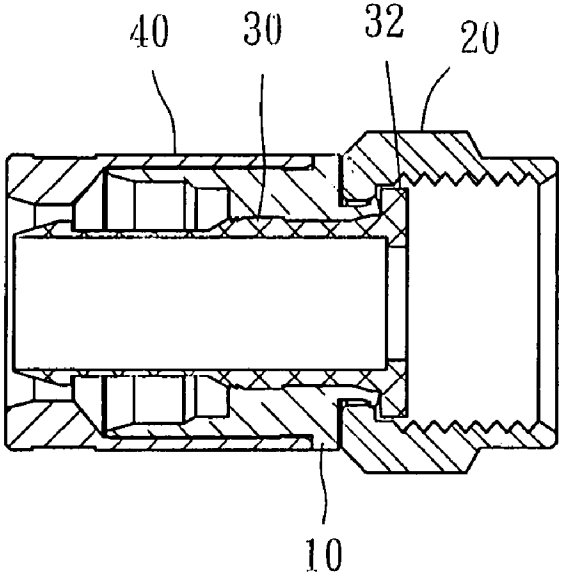
FIG. 3 is a sectional assembly view of the cable connector according to the present invention.

Referring to FIGS. 2~4, a cable connector in accordance with the present invention is shown comprised of a casing 10, a locknut 20, an inner tube 30, and a collar 40.

The casing 10 is a tubular member having an axial through hole 11 axially extending through the two distal ends and a neck 12 axially forwardly extending from its one end and terminating in an outward flange 13.

The locknut 20 has an inner thread 21, and a coupling hole 22 disposed at one end of the inner thread 21. The inner diameter of the coupling hole 22 is smaller than the inner diameter of the locknut 20, and approximately equal to the outer diameter of the neck 12 of the casing 10. By means of the coupling hole 22, the locknut 20 is coupled to the neck 12 of the casing 10.

The inner tube 30 is inserted into the casing 10 and the locknut 20, having an axial through hole 31 extending through the two distal ends, a stop flange 32 extended around the periphery of one end, namely, the front end, a stretching portion 33 formed on the periphery adjacent to the stop flange 32. The stretching portion 33 can be a sloping surface, annular flange, raised portion, or the like. According to the present preferred embodiment, the stretching portion 33 is a sloping surface. The inner tube 30 is inserted into the axial through hole 11 from one end of the casing 10 to have the stop flange 32 set inside the locknut 20.

The collar 40 is sleeved onto the casing 10 opposite to the locknut 20, having its inner diameter divided into a relatively greater clamping portion 41 at one end, a relatively smaller receiving portion 42 at the other end, and a tapered surface portion 43 gradually reducing from the relatively greater clamping portion 41 toward the relatively smaller receiving portion 42. The collar 40 is attached with its clamping portion 41 to the casing 10, and can be pushed forwards onto the casing 10 by an external force.

After insertion of the inner tube 30 into the axial through hole 11 of the casing 10 as shown in FIG. 3, the stop flange 32 of the inner tube 30 is stopped against the outward flange 13 of the neck 12 of the casing 10, and the stretching portion 33 of the inner tube 30 imparts a radially outward pressure to the neck 12 of the casing 10 to force the outward flange 13 of the neck 12 of the casing 10 into positive friction engagement with the inside wall of the locknut 20, thereby eliminating the gap between the casing 10 and the locknut 20. Therefore, the invention prevents leakage problems without the use of any additional sealing members.

Although a particular embodiment of the invention has been described in detail for purposes of illustration, various modifications and enhancements may be made without departing from the spirit and scope of the invention. Accordingly, the invention is not to be limited except as by the appended claims

What is claimed is:

1. A cable connector comprising a tubular casing, said tubular casing having a first end, a second end, an axial through hole axially extending through said first end and said second end, and a neck axially forwardly extending from said first end;

a locknut rotatably coupled to said neck of said tubular casing, said locknut having an inner thread for fastening to an external device, a coupling hole disposed at one end of said inner thread and coupled to said neck of said tubular casing, said coupling hole having an inner diameter smaller than the inner diameter of said locknut and approximately equal to the outer diameter of said neck;

an inner tube inserted into said locknut and said tubular casing, said inner tube having an axial through hole extending through two distal ends thereof, a stop flange extended around the periphery of one end thereof and stopped against said neck of said tubular casing, and a stretching portion formed on the periphery thereof adjacent to said stop flange and stopped against an inside wall of said neck of said tubular casing to force said neck into friction engagement with an inside wall of said locknut; and a collar coupled to the second end of said tubular casing and forcible onto said tubular casing toward the first end of said tubular casing by an external push force;

wherein said stretching portion of said inner tube is a sloping surface.

2. The cable connector as claimed in claim 1, wherein neck of said tubular casing has a free end terminating in an outward flange that is stopped against said stop flange of said sleeve and a part inside said locknut.

3. The cable connector as claimed in claim 1, wherein said stretching portion of said inner tube is a raised portion protruded from the surface of the periphery of said inner tube.

4. The cable connector as claimed in claim 1, wherein said stretching portion of said inner tube is an annular flange extending around the periphery of said inner tube.

5. The cable connector as claimed in claim 1, wherein said collar has an inner diameter divided into a relatively greater clamping portion at one end, a relatively smaller receiving portion at an opposite end, and a tapered surface portion gradually reducing from said relatively greater clamping portion toward said relatively smaller receiving portion.

6. The cable connector as claimed in claim 5, wherein the relatively greater clamping portion of said collar is coupled to the second end of said tubular casing.

7. The cable connector as claimed in claim 5, wherein said stretching portion of said inner tube imparts a radially outward pressure to said neck of said tubular casing to force said neck into friction engagement with a part inside said locknut when said inner tube is inserted into said locknut and said tubular casing.

* * * * *